US011448366B2

(12) United States Patent
Hsieh

(10) Patent No.: US 11,448,366 B2
(45) Date of Patent: Sep. 20, 2022

(54) DENSE FLUID RECOVERY AND SUPPLY PRESSURE SENSING SYSTEM

(71) Applicant: Hui-Ping Hsieh, Kaohsiung (TW)

(72) Inventor: Hui-Ping Hsieh, Kaohsiung (TW)

( * ) Notice: Subject to any disclaimer, the term of this patent is extended or adjusted under 35 U.S.C. 154(b) by 237 days.

(21) Appl. No.: 16/857,190

(22) Filed: Apr. 24, 2020

(65) Prior Publication Data

US 2021/0332949 A1 Oct. 28, 2021

(51) Int. Cl.

| | |
|---|---|
| ***F17C 5/02*** | (2006.01) |
| ***F17C 7/02*** | (2006.01) |
| ***F17C 13/00*** | (2006.01) |
| *F25B 45/00* | (2006.01) |

(52) U.S. Cl.

CPC ..... *F17C 5/02* (2013.01); *F17C 7/02* (2013.01); *F17C 13/007* (2013.01); *F17C 2223/0153* (2013.01); *F17C 2250/0421* (2013.01); *F25B 45/00* (2013.01)

(58) Field of Classification Search

CPC .. F17C 5/02; F17C 7/02; F17C 13/007; F17C 2223/0115; F17C 2250/0421; F25B 45/00

See application file for complete search history.

(56) References Cited

U.S. PATENT DOCUMENTS 4,100,759 A * 7/1978 Tyree, Jr. ..... F25D 3/12 62/132

2009/0158756 A1* 6/2009 Brown ..... B60H 1/00585 62/77

* cited by examiner

*Primary Examiner* — John F Pettitt, III

(74) *Attorney, Agent, or Firm* — Leong C. Lei

(57) ABSTRACT

A dense fluid recovery and supply pressure sensing system includes a dense fluid source, recovery tank and working tank, where the recovery tank is in connection with the dense fluid source with an input pipe configured with a pre-pressure valve and pre-pressure compressor, and the bottom of the recovery tank is configured with a weight measuring device measuring the weight of the recovery tank and in electric connection with the pre-pressure compressor, allowing the pre-pressure compressor to control the go and stop of the compression according to a value measured by the weight measuring device; the working tank is in connection with the recovery tank through a delivery pipe configured with a pressure building compressor and configured with a recovery pipe, another end of the recovery pipe is in connection with the input pipe of the recovery tank, and the recovery pipe is configured with a recovery valve.

1 Claim, 2 Drawing Sheets

DENSE FLUID RECOVERY AND SUPPLY PRESSURE SENSING SYSTEM

TECHNICAL FIELD OF THE INVENTION

The present invention relates to a dense fluid recovery and supply pressure sensing system, and more particularly to a recovery and supply pressure sensing system capable of recovering dense fluid and achieving safety without leakage.

DESCRIPTION OF THE PRIOR ART

Because dense fluid has the characteristics of gas and liquid phases existing at the same time under a high pressure state, it can be applied in a large range. For example, supercritical extraction, supercritical electroplating, supercritical cleaning, foaming, power generation, nano-processing, etc. can be implemented with dense fluid. However, because dense fluid has a high price and doubt about carbon emission, it will be recovered for reuse and disposal at present.

Currently, the recovered dense fluid will be stored in a tankage. However, because dense fluid is a high pressure fluid in which gas and liquid phases exist at the same time, the wall of the tankage has a certain thickness such that observation window cannot be configured for the observation of the height and volume of the fluid inside the tankage; in this situation, it is easy to cause the dense fluid in the tankage to be overlarge to leak out due to the continuous input of it, which will cause waste.

SUMMARY OF THE INVENTION

An objective of the present invention is to provide a dense fluid recovery and supply pressure sensing system, capable of recovering dense fluid and achieving the advantages of safety and no waste.

To achieve the above objective, the present invention proposes a dense fluid recovery and supply pressure sensing system, including: a dense fluid source, adapted to store dense fluid; a recovery tank, in connection with the dense fluid source with an input pipe, a pre-pressure valve and pre-pressure compressor configured on the input pipe, the pre-pressure valve adapted to control the go and stop of the dense fluid in the dense fluid source input into the recovery tank, the pre-pressure compressor capable of pre-compressing the dense fluid in the input pipe and sending the pre-compressed dense fluid into the recovery tank, a weight measuring device configured on a bottom side of the recovery tank for measuring the weight of the recovery tank, and the weight measuring device in electric connection with the pre-pressure compressor, allowing the pre-pressure compressor to adjust and control the go and stop of the compression according to a value measured by the weight measuring device; and a working tank, in connection with the recovery tank through a delivery pipe, configured with a pressure building compressor, and the pressure building compressor compressing the dense fluid sent from the recovery tank to the working tank to establish a working pressure, the working tank being a tank for working with the dense fluid, the working tank configured with a recovery pipe, another end of the recovery pipe in connection with the input pipe of the recovery tank between the pre-pressure valve and pre-pressure compressor, and the recovery pipe configured with a recovery valve adapted to control the go and stop of the dense fluid recovered from the working tank input into the recovery tank.

Whereby, the present invention provides a dense fluid recovery and supply pressure sensing system capable of achieving the advantages of safety and no waste.

DETAILED DESCRIPTION OF THE PREFERRED EMBODIMENTS

Figure 1:
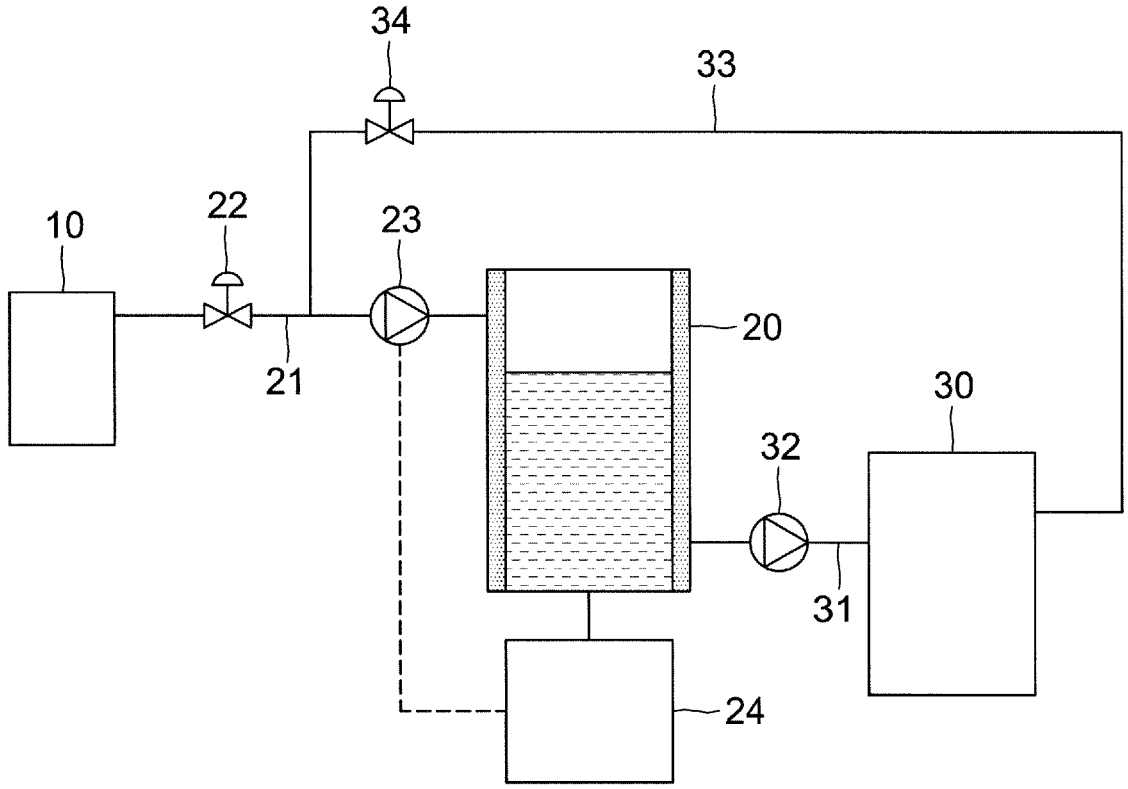
FIG. 1 is a system diagram of the present invention.

Referring to FIG. 1, a dense fluid recovery and supply pressure sensing system of the present invention, in a preferred embodiment, includes a dense fluid source 10, recovery tank 20 and working tank 30, where the dense fluid source 10, as FIG. 1 shows, is used to store dense fluid, the pressure of which is about 20-50 kg/m$^2$.

Furthermore, the recovery tank 20, as FIG. 1 shows, is in connection with the dense fluid source 10 with an input pipe 21, on which a pre-pressure valve 22 and pre-pressure compressor 23 are configured, where the pre-pressure valve 22 is adapted to control the go and stop of the dense fluid in the dense fluid source 10 input into the recovery tank 20, and the pre-pressure compressor 23 can pre-compress the dense fluid in the input pipe 21 and then send it into the recovery tank 20. In addition, the bottom side of the recovery tank 20 is configured with a weight measuring device 24 which can measure the weight of the recovery tank 20 and is in electric connection with the pre-pressure compressor 23, allowing the pre-pressure compressor 23 to adjust and control the go and stop of the compression according to the value measured by the weight measuring device 24.

The working tank 30, as FIG. 1 shows, is in connection with the recovery tank 20 with a delivery pipe 31, on which a pressure building compressor 32 is configured, where the pressure building compressor 32 can compress the dense fluid sent from the recovery tank 20 to the working tank 30 to establish a working pressure; the working tank 30 is a tank for working with dense fluid and is configured with a recovery pipe 33, another end of which is in connection with the input pipe 21 of the recovery tank 20 between the pre-pressure valve 22 and pre-pressure compressor 23. Furthermore, the recovery pipe 33 is configured with a recovery valve 34, which is adapted to control the go and stop of the dense fluid in the working tank 30 recovered and input into the recovery tank 20.

Figure 2:
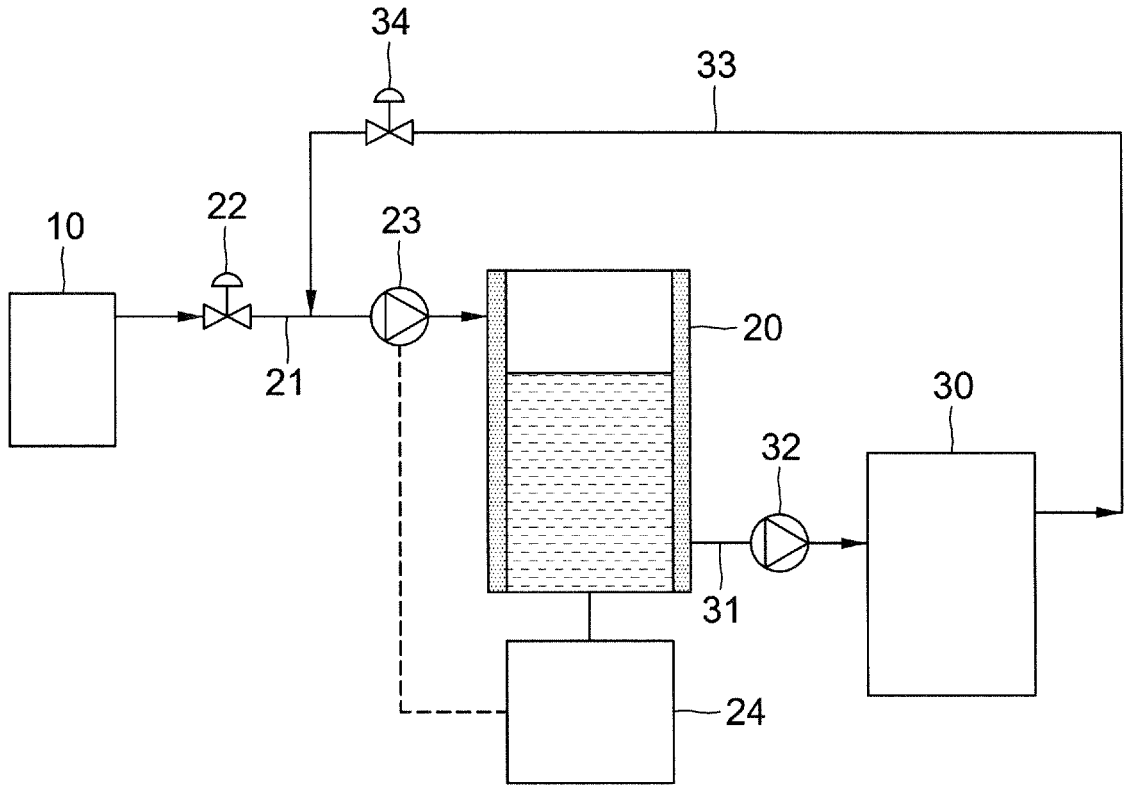
FIG. 2 is a system diagram of the present invention, where the flow direction of dense fluid is shown.

With the above structure, the upper and lower limits of the liquid level in the recovery tank 20 can be set first, and they can be converted to the upper and lower limits of the weight of the recovery tank 20, thereby adjusting and controlling the opening and closing of the pre-pressure compressor 23. Referring to FIG. 2, opening the pre-pressure valve 22 of the input pipe 21 allows the dense fluid stored in the dense fluid source 10 to be compressed to a preset pressure through the pre-pressure compressor 23, and then transported into the recovery tank 20. Furthermore, the weight measuring device 24 configured on the recovery tank 20 is used to measure the weight of the recovery tank 20, the volume and level of the liquid-phase dense fluid in the recovery tank 20 can then be known, and the go and stop of the compression of the pre-pressure compressor 23 can further be controlled, allowing the dense fluid in the recovery tank 20 to be transported through the delivery pipe 31 and enter the working tank 30 after compressed by the pressure building compressor 32 so as to perform a scheduled work.

After the work is done, the recovery valve 34 of the recovery pipe 33 is opened to allow the dense fluid in the working tank 30 to be transported to the input pipe 21 through the recovery pipe 33, allowing the dense fluid to be recovered and reused.

With the weight measuring device 24 configured on the recovery tank 20 measuring the weight of the recovery tank 20, the volume of the liquid-phase dense fluid in the recovery tank 20 can be known, thereby converting to and then judging the liquid level of the recovery tank 20; when the weight of the recovery tank 20 exceeds the preset upper weight limit, the liquid level is higher than the upper limit, so the pre-pressure compressor 22 is turned off, so that the dense fluid is no longer compressed and sent into the recovery tank 20, so as to prevent the pressure in the recovery tank 20 from being too high and leaking out; when the weight of the recovery tank 20 is lower than the preset lower weight limit, the liquid lever is lower than the lower limit, so the pre-pressure compressor 22 is turned on to compress the fluid to allow it to be transported into the recovery tank 20, and further to increase the inlet pressure of the pressure building compressor 32, thereby increasing the pressure building speed of the pressure building compressor 32. Whereby, the present invention uses the weight measuring device 24 to measure the weight of the recovery tank 20 which is then converted to the fluid level of the fluid in the recovery tank 20 to control the go and stop of the fluid recovery, so that the ratio of the dense fluid in gas and liquid phases in the recovery tank 20 can be maintained, and the advantages of safe operation and no waste can be achieved.

I claim:

1. A fluid recovery and supply pressure sensing system, comprising:

a fluid source, which supplies a fluid;

a recovery tank, which is connected to the fluid source with an input pipe to receive the fluid supplied from the fluid source, wherein a pre-pressure valve and a pre-pressure compressor are configured on said input pipe, such that said pre-pressure valve is operable to selectively supply or cut off a flow of the fluid supplied from said fluid source through the input pipe into said recovery tank, and said pre-pressure compressor is operable to compress the fluid flowing through said input pipe into said recovery tank, the fluid being compressed by the pre-pressure compressor to a predetermined first pressure to flow into the recovery tank to build up a weight of the recovery tank, and wherein a weight measuring device is configured on a bottom side of said recovery tank for measuring the weight of said recovery tank, and said weight measuring device is in electric connection with said pre-pressure compressor to selectively activate/de-activate the operation of said pre-pressure compressor to compress the fluid supplied from the fluid source through the input pipe into the recovery tank according to the weight of the recovery tank measured by said weight measuring device; and a working tank, which is in connection with said recovery tank through a delivery pipe such that a flow of the fluid is supplied from the recovery tank through the delivery pipe into the working tank, the delivery pipe being configured with a pressure building compressor, wherein said pressure building compressor is operable to compress the fluid supplied from said recovery tank to a predetermined second pressure that is fed through the delivery pipe into said working tank wherein a recovery pipe has an end connected to said working tank and is extended from the working tank, such that another end of said recovery pipe is connected with said input pipe between said pre-pressure valve and pre-pressure compressor, and a recovery valve is configured on the recovery pipe to selectively supply or cut off a flow of the fluid recovered from said working tank and fed back into said recovery tank;

wherein the fluid that is compressed by the pre-pressure compressor to flow into the recovery tank exhibits both a gas phase and a liquid phase in the recovery tank, the liquid phase of the fluid setting a liquid level in the recovery tank, wherein the liquid level is determined according to the weight of the recovery tank; and wherein the pre-pressure compressor and the pressure building compressor are separately arranged upstream and downstream of the recovery tank to separately operate for compressing the flow of the fluid supplied into the recovery tank to the first pressure fed into the recovery tank and compressing the flow of the fluid supplied out of the recovery tank to the second pressure fed into the working tank, respectively, wherein the first pressure is such that a predetermined ratio between the gas phase and the liquid phase of the fluid in the recovery tank is maintained in the recovery tank.

* * * * *